US006554165B2

(12) United States Patent
Cote

(10) Patent No.: US 6,554,165 B2
(45) Date of Patent: Apr. 29, 2003

(54) BEVERAGE DISPENSER

(75) Inventor: Cameron A. Cote, Cochrane (CA)

(73) Assignee: Cactrus Drink Systems Inc., Cochrane (CA)

( * ) Notice: Subject to any disclaimer, the term of this patent is extended or adjusted under 35 U.S.C. 154(b) by 0 days.

(21) Appl. No.: 09/805,993

(22) Filed: Mar. 15, 2001

(65) Prior Publication Data

US 2002/0130140 A1 Sep. 19, 2002

(51) Int. Cl.[7] ..... B67D 5/56

(52) U.S. Cl. ..... 222/129.1; 222/144.5; 222/145.2; 222/145.6; 222/132

(58) Field of Search ..... 222/129.1, 132, 222/144.5, 145.1, 145.2, 145.5, 145.6, 148; 137/898

(56) References Cited

U.S. PATENT DOCUMENTS

| | | | | | |
|---|---|---|---|---|---|
| 290,823 | A | * | 12/1883 | Way | 137/555 |
| 829,762 | A | * | 8/1906 | Boyer et al. | 137/636 |
| 1,370,759 | A | | 3/1921 | Oliver | |
| 2,207,196 | A | | 7/1940 | Haven | |
| 2,327,432 | A | | 8/1943 | Johnson | |
| 2,888,040 | A | | 5/1959 | Terwilliger et al. | |
| 3,199,738 | A | * | 8/1965 | Cary et al. | 137/636 |
| 3,218,175 | A | | 11/1965 | Siegel et al. | |
| 3,300,094 | A | | 1/1967 | Rockola | |
| 3,385,569 | A | | 5/1968 | Bookout | |
| 3,543,791 | A | * | 12/1970 | Fox | 137/329.1 |
| 3,586,214 | A | | 6/1971 | Diebel | |
| 3,625,402 | A | * | 12/1971 | Kulis | 137/601.14 |
| 3,723,851 | A | | 3/1973 | Johnson et al. | |
| 3,898,861 | A | | 8/1975 | McMillin | |
| 4,043,486 | A | | 8/1977 | Wisbey | |
| 4,090,475 | A | | 5/1978 | Kwan | |
| 4,194,650 | A | | 3/1980 | Nottke et al. | |
| 4,324,494 | A | | 4/1982 | Pryor et al. | |
| 4,474,214 | A | * | 10/1984 | Iannelli | 137/607 |
| 4,624,395 | A | | 11/1986 | Baron et al. | |
| 4,765,513 | A | | 8/1988 | McMillan et al. | |
| 4,856,676 | A | | 8/1989 | Emody | |
| 5,332,311 | A | | 7/1994 | Volk, Jr. et al. | |
| 5,350,082 | A | | 9/1994 | Kiriakides, Jr. et al. | |
| 5,601,210 | A | * | 2/1997 | Kelly et al. | 137/625.4 |

FOREIGN PATENT DOCUMENTS

| | | |
|---|---|---|
| CA | 1 066 675 | 11/1979 |

* cited by examiner

*Primary Examiner*—Lesley D. Morris
*Assistant Examiner*—Stephanie Willatt
(74) *Attorney, Agent, or Firm*—Bennett Jones LLP

(57) ABSTRACT

A dispenser for delivering water and/or juice has been invented. The dispenser feeds liquids by gravity and provides for a system flush at the end of each use. The dispenser can, if desired, handle more than one type of juice through a common mixing chamber and spout.

26 Claims, 11 Drawing Sheets

BEVERAGE DISPENSER

FIELD OF THE INVENTION

The present invention is directed to a beverage dispenser and, in particular, a dispenser for mixed drinks.

BACKGROUND OF THE INVENTION

Concerns over the quality and taste of domestic water supplies and the increase in consumer consumption of water products, has resulted in an increased demand for water dispensers for residential and office use. These water dispensers include an inverted water bottle that feeds water by gravity to a valve-controlled spout. While these dispensers have met with significant success, there is some resistance to having a unit in the home or office that serves only one purpose, that being to dispense water.

Dispensers are also known that dispense a juice made from a juice concentrate and water. The concentrate and water are stored separately in the dispenser but mixed prior to delivery. Such dispensers are somewhat more complex than residential water dispensers, and, as such, are generally only used in restaurants. Juice dispenser complexity arises from various issues including the need to control the ratio of water to concentrate and to clean residual concentrate from the delivery system and the use of pumps and electric solenoid valves. If the juice dispenser is intended to handle more than one type of juice, the dispenser usually has a delivery system including mixing chamber and spout for each type of juice handled.

Concerns over bacterial growth are addressed by providing elaborate flushing systems to remove concentrate residues from the delivery lines. Often the flushing system generates waste water requiring a connection to plumbing.

While it is generally accepted that an in-home dispenser that delivers both water and juice would be useful, concerns such as those mentioned previously with respect to bacterial growth, size and complexity have hindered their introduction.

SUMMARY OF THE INVENTION

A dispenser for delivering water and/or juice has been invented. The dispenser feeds liquids by gravity and provides for a system flush at the end of each use. The dispenser can, if desired, handle more than one type of juice through a common mixing chamber and spout.

Thus, in accordance with a broad aspect of the present invention, there is provided a beverage dispenser for dispensing liquids, the dispenser comprising: a liquid mixing chamber; a nozzle for dispensing fluids from the mixing chamber; a first connector for connection to a source of a first liquid; a second connector for connection to a source of a second liquid; a first tube extending between the first connector and the mixing chamber and including a first valve therein to control the flow of the first liquid through the first tube; a second tube extending between the second connector and the mixing chamber and including a second valve therein to control the flow of the second liquid through the second tube; and an actuator including a plunger extending through the mixing chamber, the plunger being moveable between a first position preventing flow of any liquids, a second position causing the first valve to open to permit flow of the first liquid into the mixing chamber and a third position causing the first valve and the second valve to open to permit a flow of the first and the second fluids into the mixing chamber.

The valves can be ball valves biased to protrude into the mixing chamber such that they are borne upon by the actuator when it moves through the mixing chamber. There can be further valves for controlling the flow of further liquids into the mixing chamber. In one embodiment, there is a third valve controlling the flow of a third liquid and the plunger is moveable into a fourth position in which the first valve and the third valve are opened to permit flow of the first and the third fluids into the mixing chamber.

The plunger can moved between the various positions by rotating the plunger within the mixing chamber and moving it axially therethrough. In one embodiment, there are guides for guiding the plunger into the various positions. In a preferred embodiment, the plunger is moveable into a locked position such that a specific unlocking procedure must be used in order to move the plunger into any of the various positions for dispensing fluids.

In accordance with another broad aspect of the present invention, there is provided a beverage dispenser comprising: a liquid mixing chamber; a nozzle for dispensing fluids from the mixing chamber; a first tube for conveying a first liquid from a source of the first liquid through an opening into the mixing chamber; and a second tube for conveying a second liquid from a source of the second liquid through an opening into the mixing chamber, the first tube emptying the first liquid into the mixing chamber above the opening of the second tube and the mixing chamber formed such that the first liquid from the first tube flows past the opening of the second tube on its way to the nozzle.

In one embodiment, an actuator is provided to control the flow of liquids into the mixing chamber. The actuator can be selected to permit the flow of the first liquid into the mixing chamber a period of time prior to permitting flow through the second opening. In addition or alternately, the actuator can be selected to maintain the flow of the first liquid into the mixing chamber for a period of time after the flow of the second liquid is stopped.

In one embodiment, the mixing chamber is formed to channel the first liquid past the second liquid opening. When an actuator is used, the actuator can include a plunger formed to effect channeling of the first liquid past the opening of the second tube. The plunger can include ribs which funnel the first liquid over the opening of the second tube.

There can be further tubes for conveying further fluids into the mixing chamber and the openings for those tubes are positioned below the opening of the first tube such that the first liquid will flow past the openings of the further tubes on its way to the nozzle.

In accordance with yet another aspect of the present invention, there is provided a beverage dispenser comprising: a beverage dispensing system including a mixing chamber, tubes for conveying liquids to the mixing chamber and a nozzle for dispensing liquids from the mixing chamber and wherein the mixing chamber, the tubes and the nozzle are all connected together by securing to a mounting bracket such that removing the bracket removes the beverage dispensing system through which liquids pass.

In one embodiment, the beverage dispensing system further includes a connector for accepting a container of a liquid and the connector is secured to the mounting bracket. The mounting bracket can be supported within a housing and the housing can include a bottle punch disposed above the connector for puncturing the container when it is disposed on the connector. The punch is selected to open an air supply port into the container. In one embodiment, the punch is recessed into the housing body and is exposed for use by insertion of the container through the housing toward the connector.

One of the tubes can include a quick disconnect that, when disconnected, seals the disconnected ends of the tube.

BRIEF DESCRIPTION OF THE DRAWINGS

A further, detailed, description of the invention, briefly described above, will follow by reference to the following drawings of specific embodiments of the invention. These drawings depict only typical embodiments of the invention and are therefore not to be considered limiting of its scope. In the drawings.

DETAILED DESCRIPTION OF THE PRESENT INVENTION

In the following description, the locational terms "above", "below", "higher", "lower" are to be interpreted with respect to gravity and the normal installation wherein dispenser is placed on its base.

Figure 1:
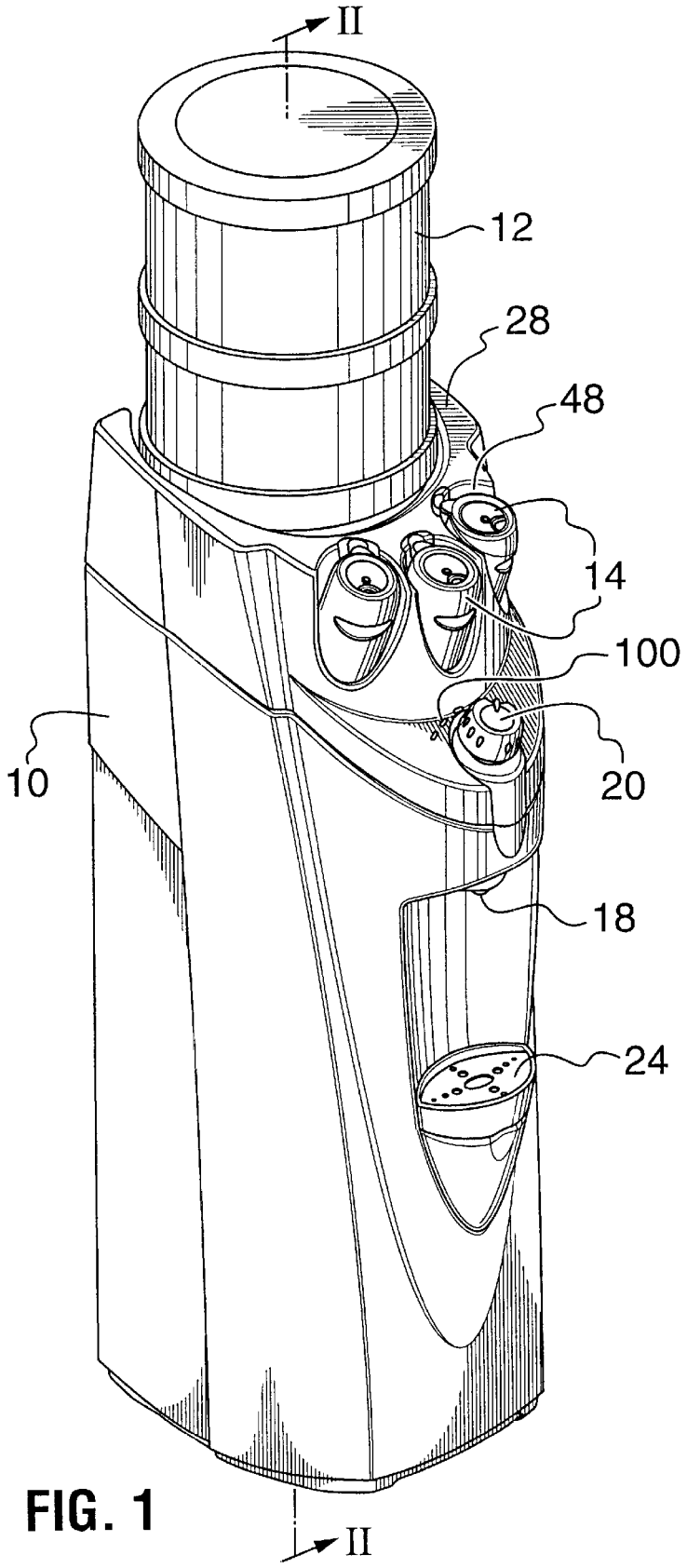
FIG. 1 is a front elevation view of a beverage dispenser according to the present invention with three concentrate bottles and a water bottle mounted therein.
Figure 2:
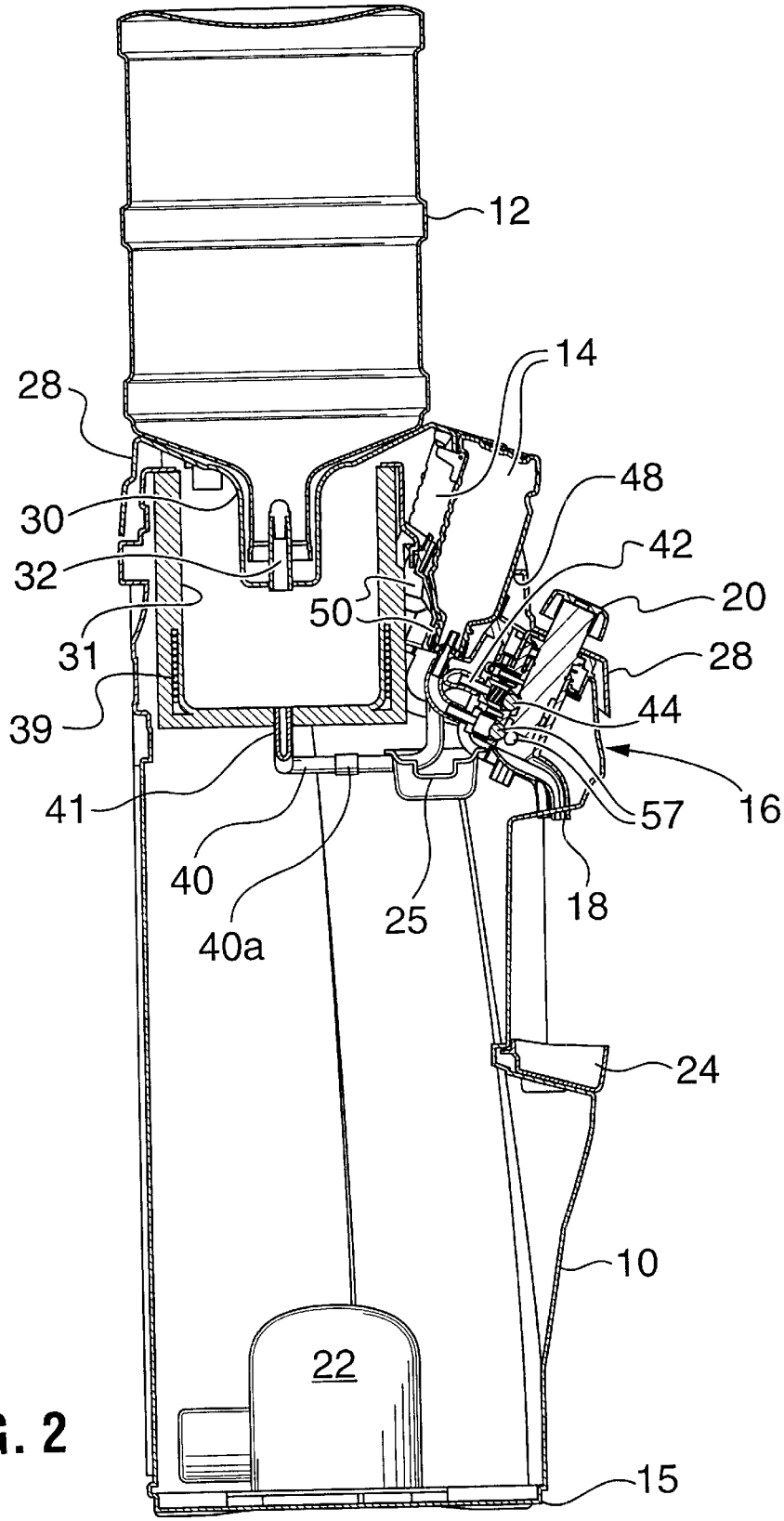
FIG. 2 is a sectional view along line II—II of FIG. 1.

Referring to FIGS. 1 and 2, a beverage dispenser according to the present invention is shown. The beverage dispenser is intended to be installed in an area of an home or office and delivers a beverage to a user, the beverage being selectable from a plurality of options including water alone or various water-diluted beverage concentrates such as natural fruit juices or punches.

The beverage dispenser includes a housing 10 for supporting a water bottle 12 for containing a source of water and three beverage concentrate bottles 14 each containing a source of beverage concentrate such as for example orange juice, grape juice and grapefruit juice concentrate. While three beverage concentrate bottles are supportable on the illustrated beverage dispenser, it is to be understood that the dispenser can be made to accommodate more or less than three bottles 14.

The housing rests on its base 15 and contains a beverage delivery system 16 for passing the water or water-diluted beverage concentrate to a nozzle 18 upon actuation of a control knob 20. The housing can also contain a refrigeration unit 22, as desired. While an electrical connection may be required in order to support the refrigeration unit, the beverage delivery system 16 preferably functions without the need for electrical power. In particular, the bottles 12, 14 preferably are positioned above, with respect to gravity, the delivery system such that the liquids contained within the bottles can flow by gravity to nozzle 18. This simplifies the system, as is important for in-home appliances.

Housing 10 can be formed in any desired way to provide support for and containment of the above-noted parts. While any durable material can be used for constructing the housing, it is preferably formed of a moldable material such as blow or injection molded plastic such as, for example, polystyrene or polyethylene. The housing should also be formed such that nozzle 18 and knob 20 are positioned at a convenient height for installation of the water bottle. The heavy components of refrigeration unit 22 such as the compressor and heat exchange are preferably positioned low in the housing to lower the center of gravity of the dispenser and increase stability thereof. Of course, housing 10 is preferably as compact as possible.

In the illustrated embodiment, housing 10 further supports a drip tray 24 to support a vessel (not shown) beneath the nozzle and to collect drips. Within housing 10, another drip tray 25 can be disposed beneath beverage delivery system. This prevents any water or concentrate leakage from dropping down into the housing and onto the refrigeration unit. Drip tray 25 contains fluid that leaks into it and can be removed and cleaned when cleaning other components, as will be described hereinafter.

Housing 10 can be formed of a plurality of sections to facilitate manufacture and assembly. To provide access to internal components various removable panels can be provided. As an example, a removable upper panel 28 is provided for access to portions of the beverage delivery system within the housing. To remove panel 28, control knob 20 must first be removed. This procedure will be described in greater detail hereinafter.

Water bottle 12 is supported in an assembly known in standard water dispensers. In particular, housing 10 defines a generally frustoconical bowl 30 for supporting the bottle and includes a reservoir 31 and a no-spill water safe pin 32. Reservoir 31 has disposed thereabout refrigerant lines 39. As will be appreciated, other water supply arrangements can be used such as for example a point of use water supply wherein the dispenser is connected to a domestic water supply, which is filtered and/or refrigerated prior to use.

A tube 40 extends between outlet port 41 of reservoir 31 and a water inlet port 42 of beverage delivery system 16. Tube 40 includes therein a quick disconnect **40*a* that seals off the disconnected ends of the tube. A valve 44 is positioned to control the flow of water through tube 40. When valve 44 is open and quick disconnect 40*a* is connected, water will flow by gravity through the tube until the level of water in reservoir 31 equals the height of water inlet port 42**.

Concentrate bottles 14 extend through openings 48 in housing 10 and each bottle is seated in its own support 50. With reference also to FIGS. 3 through 6, each support 50 is shaped to receive a bottle and includes a feed tube 52 mounted therein for insertion into the bottle. Supports 50 are formed on a beverage delivery system support plate 51. This support plate is connected to other components of the delivery system to facilitate handling and installation thereof, as will be described in greater detail hereinafter. Also described hereinafter are a particularly preferred bottle and support arrangement.

The beverage concentrate contained in bottle 14 drains through feed tube 52 and into a tube 54, which is connected to a concentrate inlet port 56 of the beverage delivery system. As will be appreciated, an air supply must be available inside the bottle, either through feed tube or another opening, to prevent the formation of an air lock. Concentrate flows by gravity through tube 54 to inlet port 56. A valve 57 controls the flow of liquid through tube 54. While there is preferably only one water inlet port 42, preferably there are as many inlet ports 56 as concentrate bottle supports 50. By providing an inlet port for each support, a plurality of flavours of juice concentrate can be used without cross contamination thereof.

While this concentrate bottle mounting arrangement is preferred for ease of manufacture and cleaning, other arrangements can be used for supporting the concentrate bottles in a position to deliver concentrate by gravity through tubes 54 to inlet ports 56. For example, the supports could be formed by the housing or only one opening could be formed through the housing for insertion therethrough of the bottles.

Water inlet port 42 and concentrate inlet ports 56 open into a mixing chamber 58 where water and concentrate are mixed. Mixing chamber 58 is formed as a generally cylindrical structure with an inner bore 59 and a long axis 58*x*. Mixing chamber 58 has an open, upper end 60 and a lower end 61 in fluid communication with nozzle 18. The mixing chamber is preferably orientated with end 60 higher than end 61 so that liquids entering the chamber will flow by gravity toward end 61. The mixing chamber can be tilted as shown to improve ergonomics.

Inlet port 42 is disposed above inlet ports 56 such that water entering mixing chamber 58 through inlet port 42 can pass downwardly by gravity over one or more of ports 56 provided, of course, that the inlets 42, 56 are appropriately positioned and/or the water is channelled accordingly. Inlet ports 56 are preferably spaced apart substantially inline about a circumference of the mixing chamber. Thus, each port 56 is positioned a substantially equal distance from end 60 of the mixing chamber. It is to be understood, however, that ports 56 can be positioned in other ways such as, for example, one above the other.

Mixing chamber 58 includes an air inlet 63*a* to prevent the formation of an air lock in the chamber. In one embodiment, an overflow tube 63*b* is connected at the air lock and extends to convey liquids that may build up within the mixing chamber, as by plugging nozzle 18, to a position such that they drop into drip tray 24.

A plunger 62 is slidingly disposed in bore 59 of the mixing chamber and can be moved within the mixing chamber to control the flow of liquids into the bore. In particular, valves 44, 57 are controlled to open and close by the plunger 62 moving within the mixing chamber 58. In a preferred embodiment, valves 44, 57 are spring-biased ball valves each including, with reference to valve 44, a ball 65 that is biased by a compression spring 66 to seal against valve seat 67. As will be appreciated, the ball valves could be replaced with plunger valves. Thus, valves 44, 57 will be normally closed and only opened by applying force to the balls from within the mixing chamber. Such force is applied by plunger 62. In particular, valves 44, 57 are each positioned in their inlet ports such that balls 65 protrude into mixing chamber 58 and plunger 62 is formed to ride over one or more of the balls to open the valves.

Figure 7A:
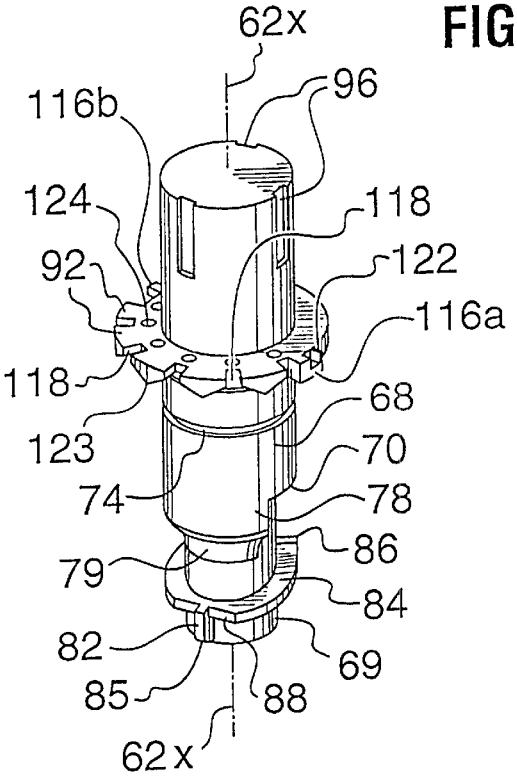
FIG. 7 is a perspective, top plan view of a plunger useful in a beverage delivery system.
Figure 7B:
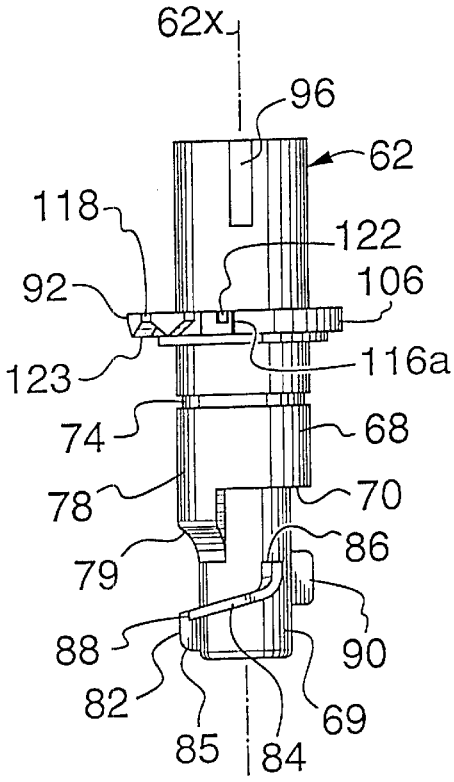
Figure 8A:
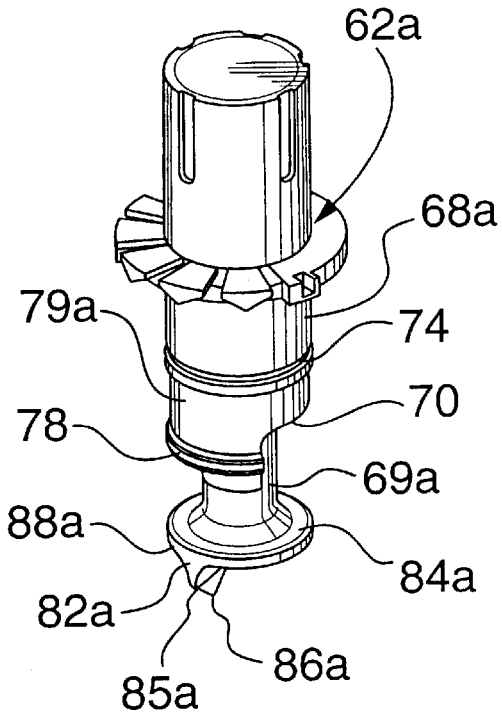
FIG. 8 is a side elevation view of the plunger of FIG. 7.
Figure 8B:
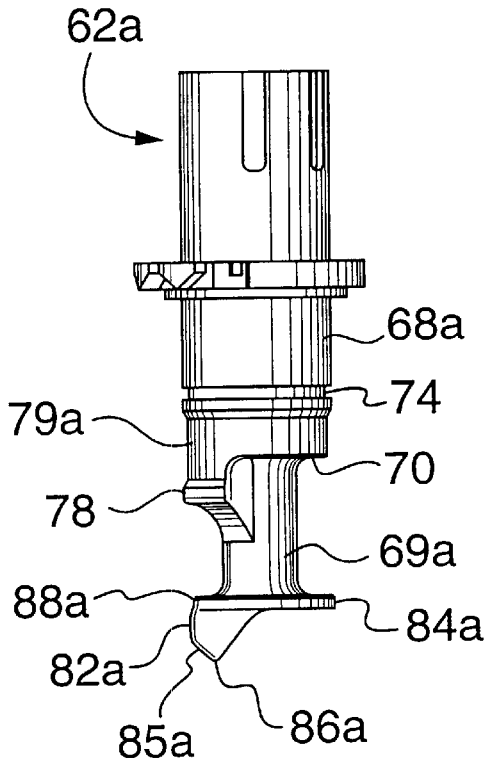

Referring also to FIGS. 7 and 8, a preferred plunger 62 is shaped to fit in close tolerance within the bore of mixing chamber 58, to actuate valves 44, 57 in selected combinations and sequences and to channel liquids within the mixing chamber. Plunger 62 includes a middle portion 68 with an outer diameter just less than the inner diameter of mixing chamber 58 and a lower end 69 with an outer diameter less than that of the middle portion. A shoulder 70 is formed between middle portion 68 and lower end 69.

The middle portion includes a groove 74 for receiving an o-ring 76 for sealing against the inner surface of mixing chamber 58. A bearing surface 78 for bearing against valve 44 is formed by middle portion 68. Bearing surface 78 includes leading edge 79. While the bearing surface could be extended about the entire circumference of the plunger, it is discontinued in the present embodiment to provide for a locked-off position.

Lower end 69 includes a concentrate valve bearing surface 82 and a pair of channel ribs 84 extending outwardly below bearing surface 78. Bearing surface 82 includes a leading edge 85 and is sized such that it can bear on one valve 57 but can also fit in the space between two adjacent valves 57 without bearing on either of them. From their upper ends 86, channel ribs 84 slope away from bearing surface 78 and converge toward bearing surface 82. While the effective outer diameter between the outer edges of the channel ribs at their upper ends 86 is substantially equal to the outer diameter of middle portion 68, channel ribs 84 include notches 88 that effectively reduce their outer diameter adjacent bearing surface 82.

The distance between leading edge 79 of bearing surface 78 and leading edge 85 of bearing surface 82 is equal to or, preferably, less than the distance d1 between the centre point of valve 44 and the centre point of valves 57, when measured along a line parallel to long axis 58*x*.

Figure 4:
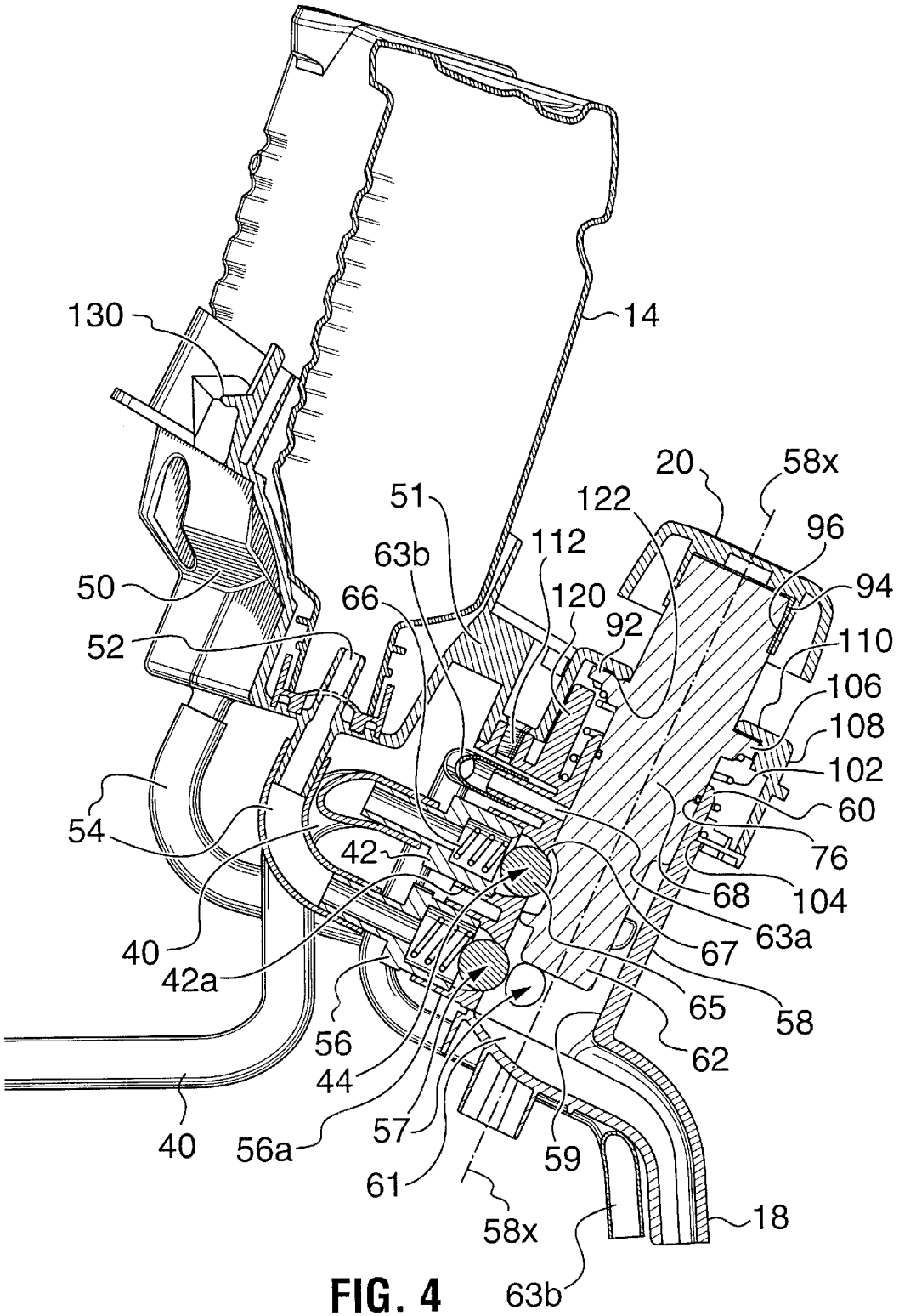
FIG. 4 is an sectional view along line IV—IV of FIG. 3.

In use to actuate valves 44, 57 and thereby to dispense beverages, plunger 62 is disposed in mixing chamber 58. Normally, when the dispenser is not in use to dispense a beverage, plunger 62 is positioned in bore 59 with bearing surface 78 spaced above, but not depressing, valve 44. In that position, bearing surface 82 is not bearing on valve 57. This plunger position is shown in FIG. 4.

To dispense a beverage, the plunger must be rotated such that its bearing surfaces are in alignment with selected valves and pushed into the bore of the mixing chamber to cause bearing surfaces 78 and possibly 82 to ride over the selected valves. In particular, to dispense water only, plunger 62 is rotated such that bearing surface 78 is aligned with and above valve 44 and bearing surface 82 is positioned to pass on either side of but not over any valves 57. This is the exact position shown in FIG. 4. Plunger 62 is then moved within bore 59 along axis 58*x* such that bearing surface 78 rides over ball 65 of valve 44 to force it against the resistance in spring 66 to open the valve. Since bearing surface 82 is positioned only to pass around but not over any valves 57, no concentrate will be dispensed with the water.

To dispense a beverage consisting of a mixture of water and concentrate, plunger 62 is rotated such that bearing surface 78 is aligned with and above valve 44 and bearing surface 82 is aligned with and above a selected one of valves 57. Plunger 62 is then moved within bore 59 along axis 58*x* such that bearing surface 78 rides over the ball of valve 44 and bearing surface 82 rides over the ball of the selected one of valves 57. As will be appreciated, the concentrate valve 57 which is selected will depend on the type of concentrate that is desired to be mixed with the water to form the beverage.

When valve 44 is opened by the plunger to permit water to pass into mixing chamber, the water flows out against plunger and by gravity flows toward end 61. As the water passes between plunger 62 and the mixing chamber inner wall, ribs 84, which have an effective outer diameter just less that of the inner diameter of bore 59, create a restriction to the flow of water therepast such that water tends to be funnelled along the channel ribs and through notches 88 where the ribs are spaced form the inner wall. Water flowing through notches 88 flows around bearing surface 82. When bearing surface 82 is bearing on a valve 57, ribs 84 function to enhance mixing of the water with the concentrate and to direct the water to provide a better rinse.

It is not necessary that ribs 84 be in total sealing engagement with the inner wall of bore 59 to effectively channel water. However, they should extend out around a suitable portion of the circumference of the plunger to effectively cover all possible orientations of the plunger relative to inlet 42.

To enhance cleaning of the mixing chamber and to reduce cross contamination of concentrates with other concentrates or plain water, whenever a water-diluted concentrate beverage is dispensed preferably valve 44 is opened before and closed after valve 57. To achieve this, bearing surface 78 can be formed on plunger 62 such that it will always depress the ball of valve 44 before bearing surface 82 comes to bear on the ball of valve 57. This can be easily achieved by positioning leading edges 79 and 85 closer than the distance dl between valve 44 and the line of valves 57. This pre and post flush has proved very effective in cleaning valves 57 and removing any residual concentrate from the mixing chamber. In fact, when plain water is drawn from the dispenser directly after a blended beverage of water and a concentrate, the concentration of concentrate in the plain water was extremely low. This concentration of concentrate in plain water has been found to be undetectable in taste and appearance.

As will be appreciated, repositioning the valves 57 relative to each other and to valve 44 may require adjustment of the bearing surfaces on the plunger and of the general operation of the plunger. For example, if valves are positioned one above the other under valve 44, the plunger could be formed to select the depth into which it is inserted into the mixing chamber to select a particular valve 57.

In order to produce a particular beverage, it will sometimes be necessary to adjust the proportion of water which is added relative to the amount of concentrate. This can be achieved by adjusting the relative size of the valves 44, 57 or the relative size of ports 42, 56, by adjusting the concentration of the concentrate, by adjusting the effective outer diameter at bearing surface 78 relative to the effective outer diameter at bearing surface 82, or by adjusting the distance between leading edges 79, 85 so that valve 44 is depressed more than any of valve 57. In the presently preferred embodiment, the effective outer diameter at bearing surface 78 is larger than the effective diameter at bearing surface 82 so that the ball of valve 42 is depressed to a greater extent than the concentrate valves and thus more water is released than concentrate.

While ribs 84 act to channel water within the mixing chamber, they also act as centralisers maintaining effective contact between the bearing surfaces and their valves. However, depending on the force in valves 44, 57, one or more centralisers 90 can be formed on the plunger in a position generally diametrically opposed to the bearing surfaces.

As will be appreciated, radiusing or ramping leading edges 79 and 85 facilitates actuation of the valves. While the inlets 56 can be positioned anywhere in the mixing chamber below valve 42, it is preferred for ease of manufacture and operation that the valves 57 be grouped below valve 42 generally in line with long axis 58*x*.

The plunger can be moved between the various positions within the mixing chamber in various ways. However, preferably, as illustrated, the plunger is actuated by control knob 20 and the plunger is constrained by guides 92 to move along a selected path to open or close the various valves.

Knob 20 includes keys 94 that engage in keyways 96 at the upper end of plunger 62. The keys and keyways are formed such that knob 20 can be installed over or removed from plunger 62 by application of force along the plunger's long axis 62*x*. However, the interaction of the keys in keyways 96 prevents knob 20 from rotating relative to the plunger about long axis 62*x*. Preferably, the keyways 96 are formed such that knob can only be installed on the plunger in one orientation. This ensures that the reference marker 98 on the knob is always at a known orientation relative to the structures on the plunger such as bearing surface 82. Once panel 28 is disposed over the beverage delivery system, marker 98 can be aligned with selection markers 100 on the housing.

Normally it is desirable to have valves 44 and 57 closed so that no beverages are dispensed through the nozzle. Thus, preferably a compression spring 102 is disposed to act between a shoulder 104 on the mixing chamber and a flange 106 encircling plunger 62. Spring 102 biases plunger 62 upwardly in mixing chamber with bearing surface 78 above and not bearing on valve 44. To open valve 44, force can be applied to knob 20 to overcome the tension in the spring to drive the plunger down into the mixing chamber and bearing surface 78 against the ball of valve 44 to release water. Depending on the rotational orientation of the plunger in the mixing chamber, this action may also cause bearing surface 82 to ride over a valve 57.

A cap 108 is secured to mixing chamber 58 by, for example, a fastener 112 and extends upwardly about the plunger. Cap 108 includes a stop wall 110 to engage against flange 106 to prevent the plunger from being driven entirely out of the mixing chamber by spring 102.

Flange 106 limits insertion of the plunger into the bore of mixing chamber by abutting against end 60. In particular, it will be appreciated that the distance between flange 106 and bearing surface 82 must be selected with consideration as to the distance between upper end 60 of the mixing chamber and the level of inlet ports 56 such that when flange 106 abuts on end 60, bearing surface 82 is disposed in line with or on one of valves 57.

In the illustrated embodiment, flange 106 also has mounted thereon guides 92 for directing the rotational positioning of plunger 62 within the mixing chamber and, in particular, bearing surface 82 with respect to valves 57. Guides 92 extend out radially in spaced apart relation from flange 106 such that slots 118 are defined therebetween.

A rib 120 is mounted adjacent the upper end of mixing chamber 58 and is sized to fit into slots 118. Rib 120 extend up to a position spaced sufficiently below stop wall 110 such that guides 92 can move therebetween without meshing with the rib. However, when plunger 62 is advanced into the bore of the mixing chamber, guides 92 are driven down onto ribs 120 so that the rib moves into one of slots 118. This prevents plunger 62 from rotating with respect to the mixing chamber. To facilitate meshing with the rib, guides 92 are wedged shaped on their bottom surface 122.

Rib 120 is positioned with consideration as to the positions of valves 57 and guides 116 are positioned with consideration as to the position of bearing surface 82 so that the meshing of the rib with the guides causes bearing surface 82 to be aligned with or on either side of, valves 57. Further, marker 98 on knob 20 and markers 100 on the housing are oriented with respect to the guides 116 and rib 120, respectively, so that there is a visual indication as to which of the valves 57 will be opened by the plunger if it is advanced into the mixing chamber in that particular position. Markers 100 preferably show one or more positions at which the knob can be rotated and pressed to dispense plain water from the unit and one position for each valve 57. Various indicators can be used to identify what particular beverage flavour will be dispensed at that marker position. In one embodiment, bottles 14 are mounted in the housing adjacent the markers so that it is apparent that depressing the knob when the marker 98 is pointing towards that bottle will dispense that bottle's concentrate. The various bottles 14 can be formed of clear material or colour coded so that it is apparent which type of beverage, orange, grape, etc., will be dispensed if the knob is rotated to that particular position and pressed.

Thus, in use knob 20 is rotated, without pressing on it, to align marker 98 with a particular marker 100 that identifies the beverage that is desired to be dispensed. Then pressure is applied to the knob to push it toward the housing. This causes guides 116 to mesh with the rib and plunger 62 to be guided along a path parallel with long axis 58*x* of mixing chamber. As plunger 62 is advanced valve 44 and possible one of valves 57 are opened to allow the liquids of the particularly selected beverage to flow into mixing chamber 58 and out through nozzle 18.

Rotation of knob 20 is limited by abutment of end guides 116*a,* 116*b* against a spline 121 on top cap 108. The knob can be locked into an off position by pressing against the tension in spring 102 and engaging spline 121 in an cavity 122 on end guide 116*a*. Once pressure is released, spring 102 will drive spline into engagement with cavity and prevent rotation of the knob.

To provide some resistance to rotating knob 20 and to cause a noticeable indication when the plunger is in a position ready to be meshed with rib 120, a pin 122 is formed on the inner surface of cap 108 and is sized to fit within indentations 124 on the flange of plunger.

Figure 3:
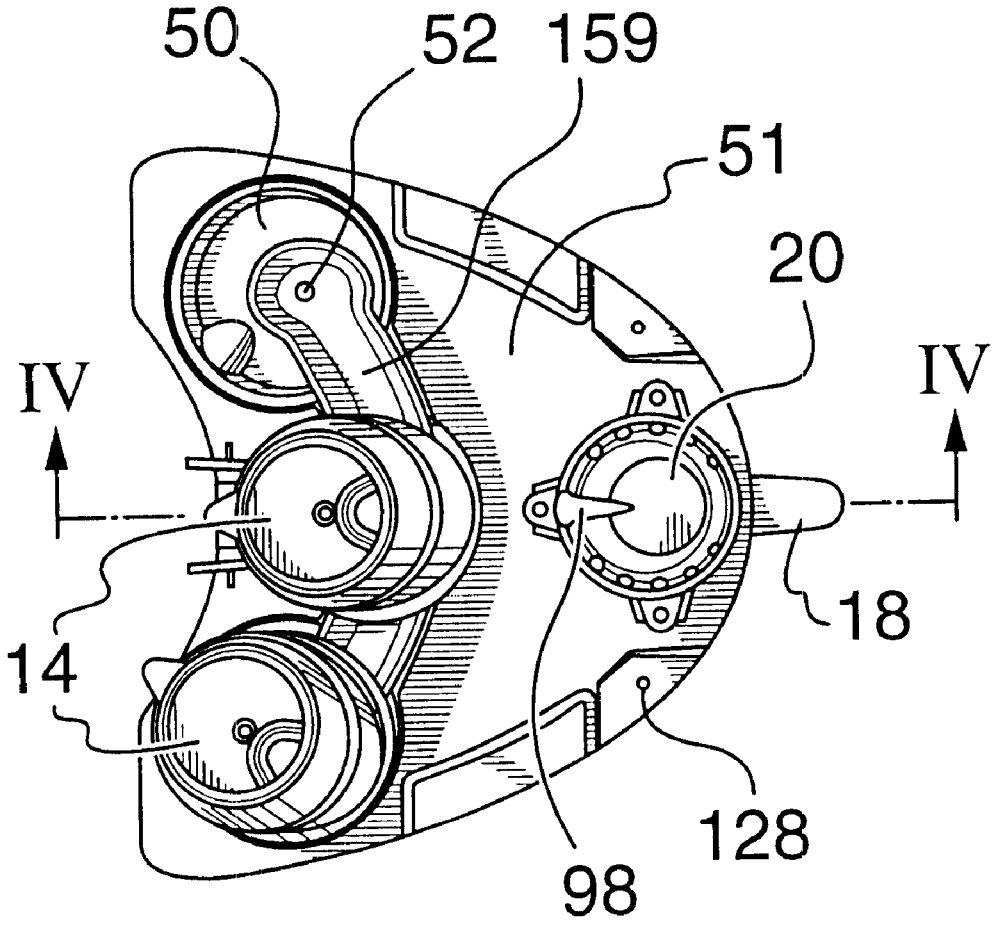
FIG. 3 is a perspective view of a beverage delivery system according to another aspect of the present invention.
Figure 5:
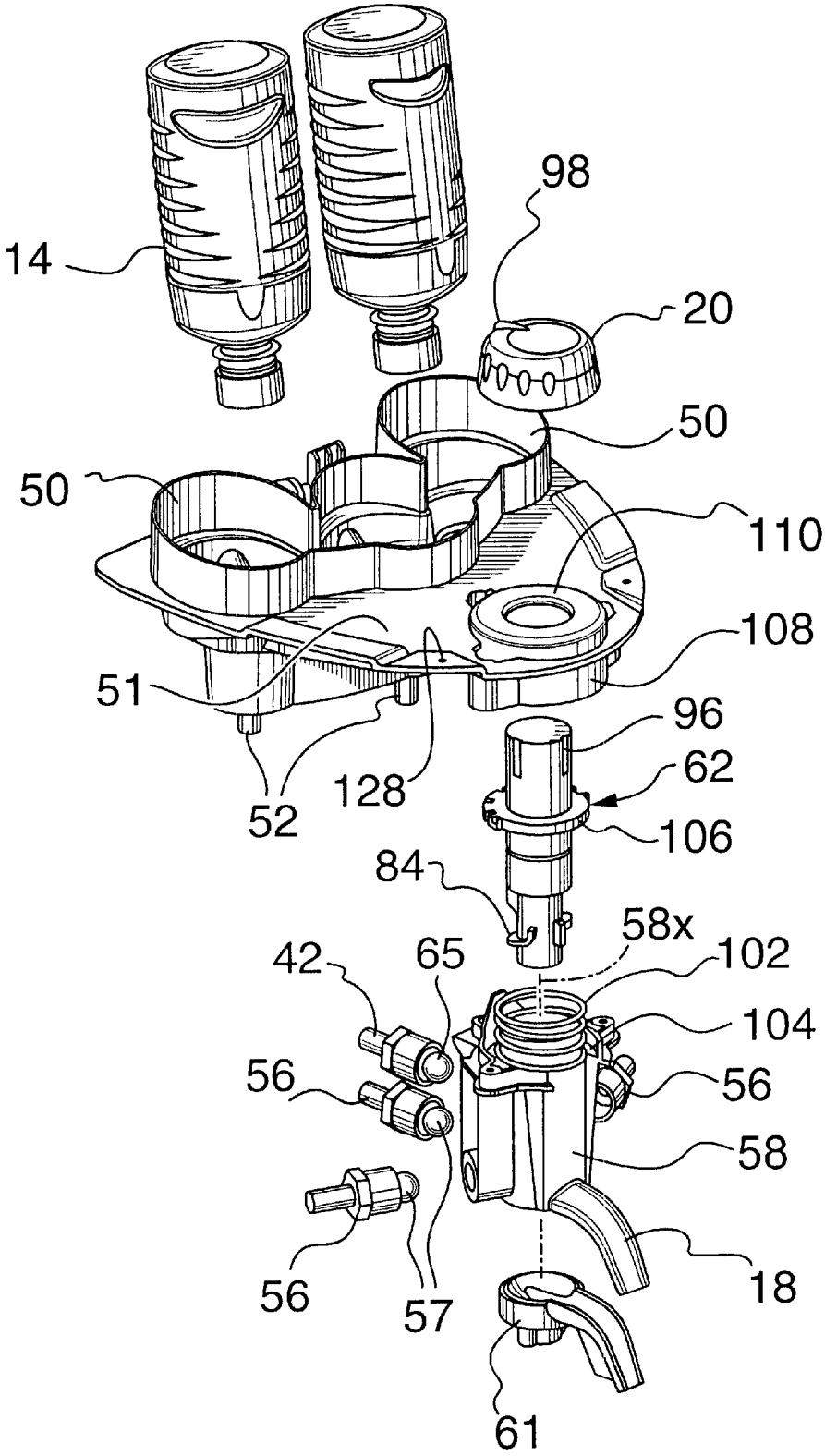
FIG. 5 is an exploded view of the beverage delivery system of FIG. 3.
Figure 6:
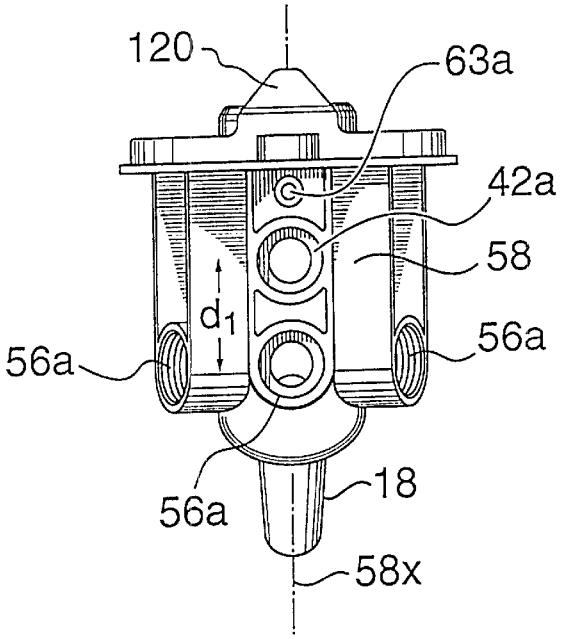
FIG. 6 is a perspective view of a mixing chamber useful in the present invention.
Figure 9:
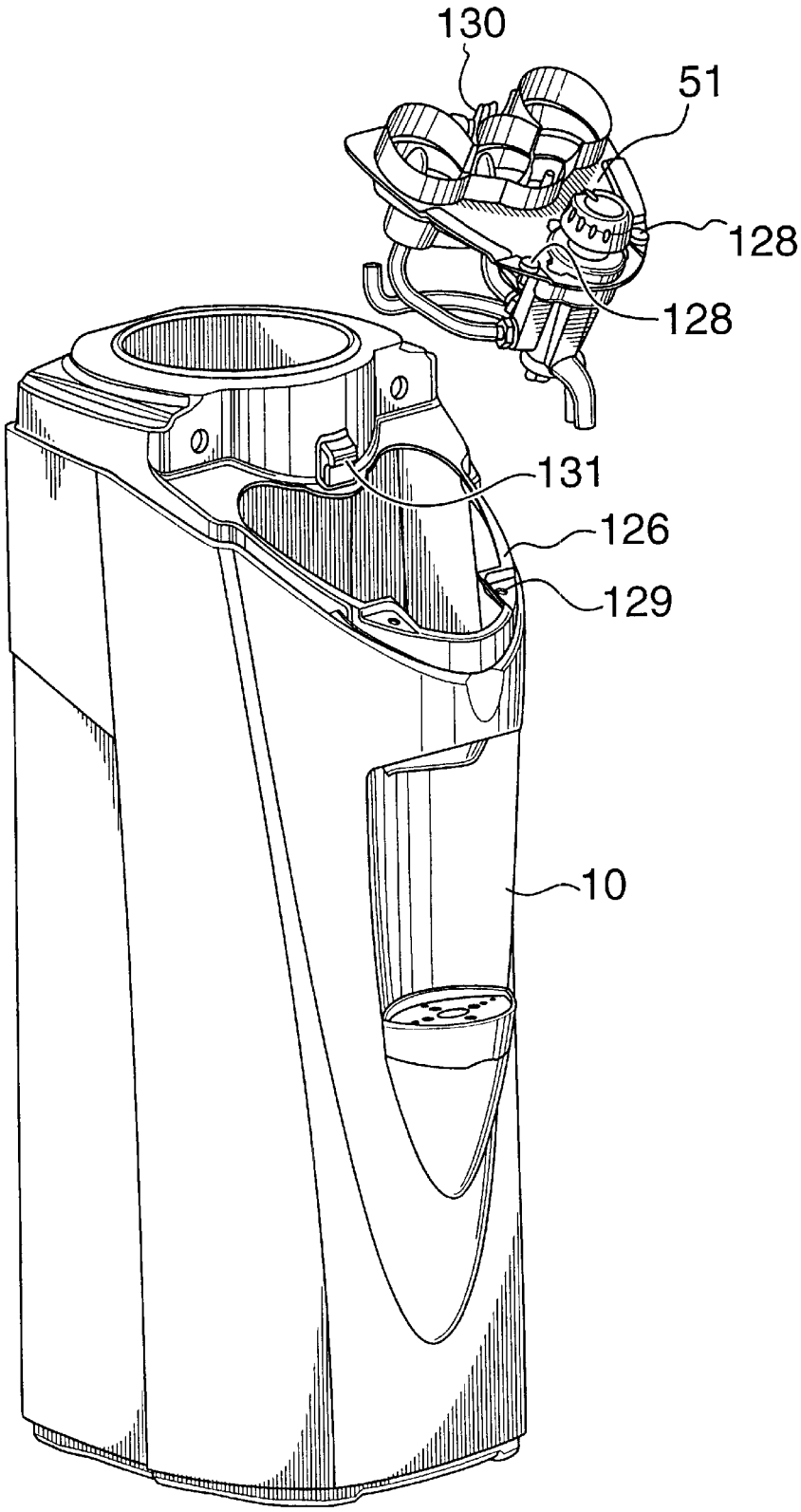
FIG. 9 is a perspective view of a beverage dispenser according to the present invention partially dismantled.

As noted previously, supports 50 are preferably formed as a part of or connected to a beverage dispenser system support plate 51. Preferably other parts of the fluid delivery system 16 that convey concentrate are also connected to or formed integral with support plate 51. In particular, as can be seen in FIGS. 3 to 5, cap 108 is formed integral with plate 51 and mixing chamber 58 is secured to cap 108 by a fastener. Plunger 62 is maintained between mixing chamber and cap 108. With reference to FIG. 9, housing 10 includes a flange 126 onto which plate 51 rests while mixing chamber 58 and nozzle extend down into the housing. Apertures 128, 129 are formed through the plate and flange 126 respectively to accept fasteners (not shown) for securing the plate to the flange. A leaf spring catch 130 engages under a shoulder 131 on the housing or under the flange, holding the plate in place. Thus, it is possible to remove the entire fluid delivery system at the same time. This facilitates cleaning and maintaining the dispenser. To remove the fluid delivery system 16, knob 20 is removed from plunger 62, upper housing panel 28 is lifted off, tube 40 is disconnected at quick disconnect 41, the fasteners through apertures 128, 129 are removed, and catch 130 is biased out from under shoulder 131 so that plate 51 can be lifted off the flange. This procedure may also require that bottles 14 be removed prior to removing the upper housing panel.

The parts of the fluid delivery system can be constructed in various ways. As will be appreciated by those skilled in the art, preferably any parts constructed of polymeric materials will be moulded in parts. As an example, it is particularly convenient to produce the mixing chamber and nozzle in two sections, which are secured together by welding or adhesives. In addition, preferably inlet ports 42, 56 are formed by threaded fittings fit into threaded openings formed in the wall of the mixing chamber. Any parts that are intended to convey or be in contact with beverage liquids must be formed of food-grade materials safe for contact with potable water. Some suitable materials are food-grade PVC, silicone, an acetyl (i.e. Delron®) and a PTFE (i.e. Teflon®). Any metal components should be constructed to withstand extended periods in contact with water and concentrated juices without rusting or corroding. In particular, stainless steel is preferred. Some chrome parts may tend to corrode and should be avoided.

Figure 10:
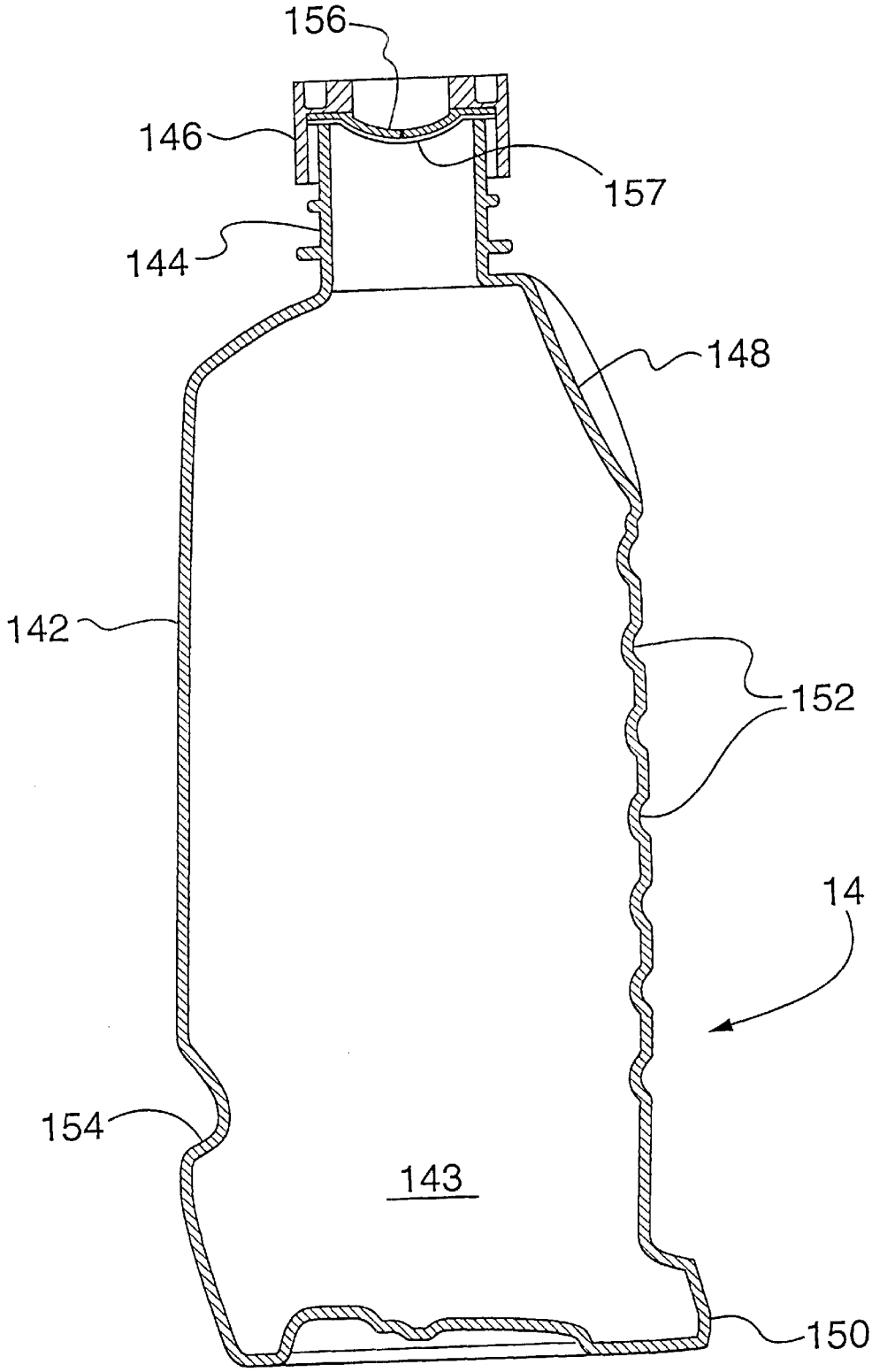
FIG. 10 is a side elevation view of a concentrate bottle useful in the present invention.
Figure 11:
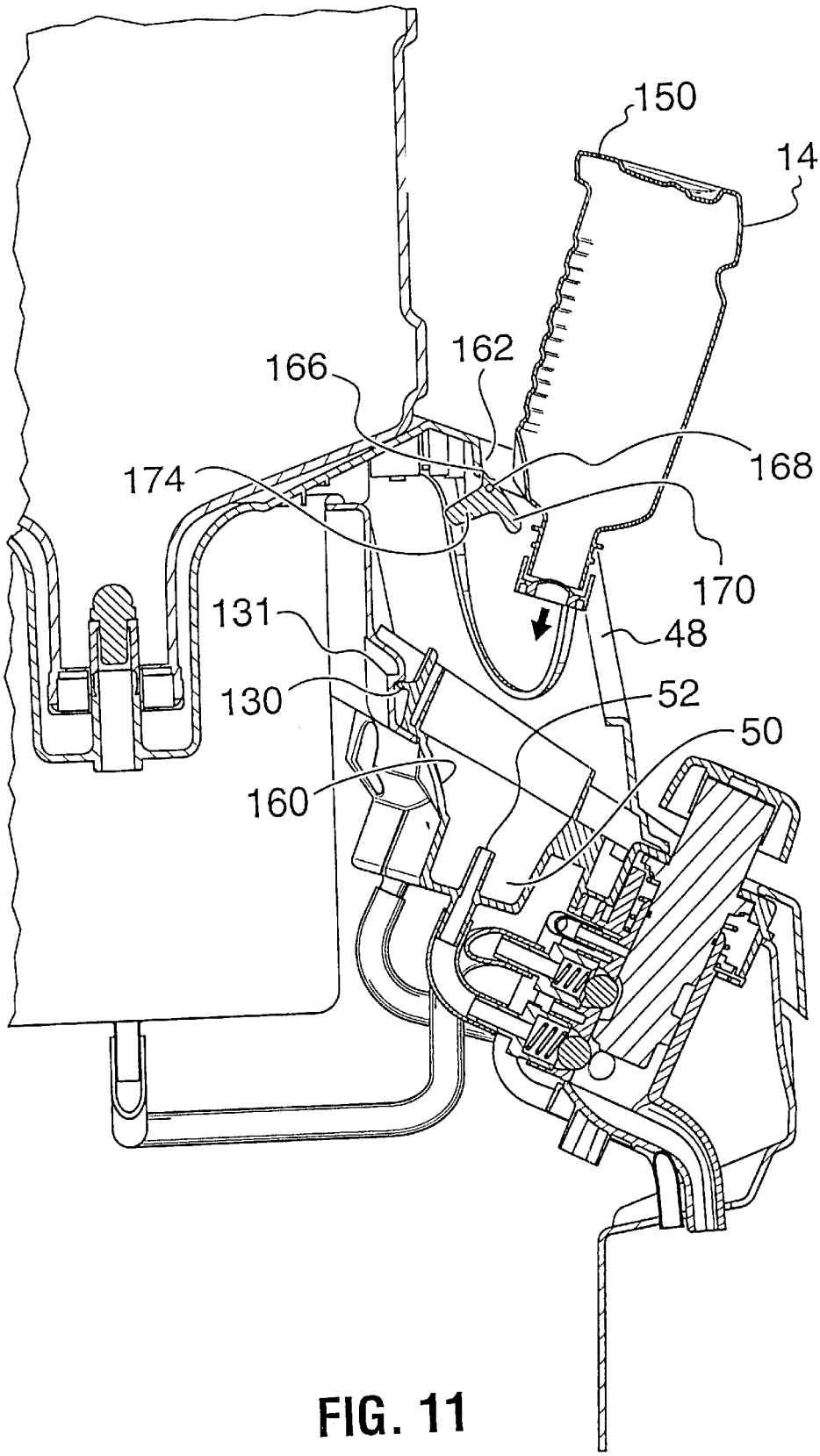
FIG. 11 is a sectional view showing a bottle aligned for entry into a concentrate bottle support.
Figure 12:
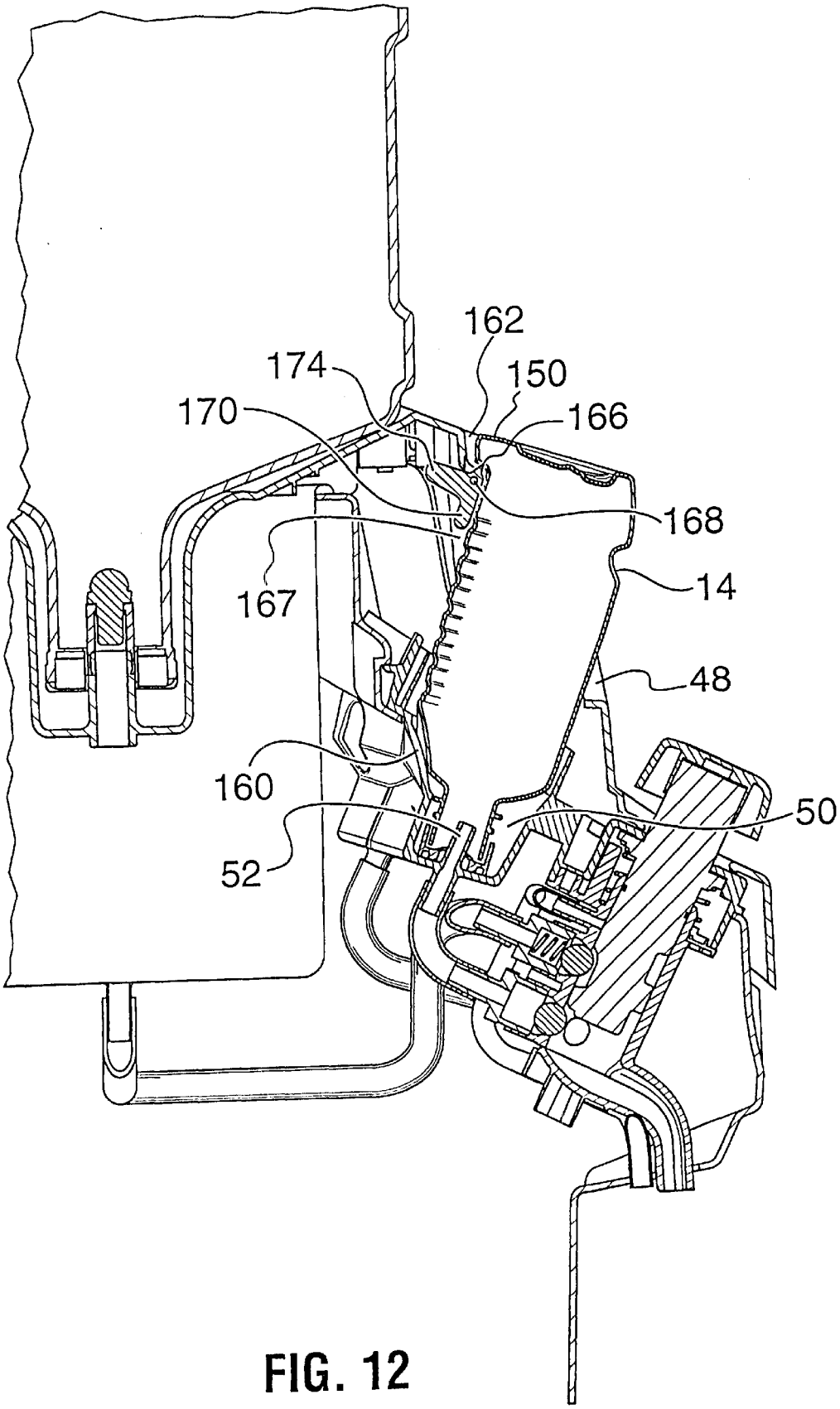
FIG. 12 is a sectional view showing a concentrate bottle seated in a bottle support and ready for use.

As noted previously and referring now to FIGS. 10 to 12, in one embodiment a dispenser according to the present invention uses a particularly preferred concentrate bottle 14 and concentrate bottle support arrangement. Bottle 14 includes a container body 142, defining an inner chamber 143, and a neck 144 over which a cap 146 is installed, as by threading. Container body 142 includes an indentation 148 formed adjacent neck 144 and a protrusion 150 adjacent its base. Protrusion 150 is formed of thin material, similar to the material thickness of the container body such that inner chamber 143 extends into the protrusion. The protrusion can be thinned to facilitate use of the bottle in the present dispenser. Preferably the bottle is formed of a thin material such as PET.

Container body can include ribs 152 and/or notches 154, as shown, can be knurled or otherwise treated on its outer surface to facilitate secure grasping by a user.

Neck 144 is covered by an elastomeric seal 156, for example, formed of silicone. The seal can be sealed over the neck or mounted on cap 146. The seal is pre-punctured and formed to prevent leaking. A Styrofoam liner is provided beneath seal 156 to further avoid leakage and tampering.

As noted previously, bottle 14 is inserted, opening 144 end first, through an opening 48 in upper panel 28 and into a bottle support 50 in fluid delivery system support plate 51. Bottle support 50 is shaped to receive bottle 14 and is formed for easy cleaning and preferably is sized to contain the full volume of a bottle, should a leak occur. In particular, connecting channels 159 are formed between supports 50 to enlarge their volumes. In a preferred support 50, a raised portion 160 is formed therein to fit within indentation 148 on the bottle. Thus, preventing other bottles, which are not intended to be used with the present dispenser, to be mounted in bottle support 50. The bottle support further includes a rigid feed tube 52. Feed tube 52 is formed to be inserted through seal 156. The seal being elastomeric will seal about the feed tube and prevent leakage of concentrate at the interface therebetween.

Opening 48 preferably includes a cavity 162 into which protrusion 150 can rest. Cavity 162 includes a punch 166 which will puncture the bottle at the protrusion forming a passage through which air can flow to fill the bottle as the concentrate drains through feed tube 52. To avoid injury the punch can be recessed in cavity 162, until a bottle is inserted through the opening. In one such arrangement, punch 166 is mounted in a slot 167 in the cavity and is secured to or formed part of a member connected to panel 28 through a pivot pin 168. The member includes an end 170 that is safe for contact by a user. The punch and end 170 are arranged about pivotal connection at pivot pin 168 such that end 170 is normally biased to protrude into opening 48 and drive punch 166 to be recessed in the slot formed in cavity 162. However, when a bottle 14 is inserted through the opening it contacts end 170 and drives the member to rotate about pin 168 to expose the punch in cavity 162. End 170 can be biased into the opening by a counterweight 174, as shown, or, for example, by including a spring (not shown) to act about pivot pin.

This preferred concentrate bottle and concentrate bottle mounting arrangement provides a safe and clean way to supply, handle and dispense concentrate.

It will be apparent that many other changes may be made to the illustrative embodiments, while falling within the scope of the invention and it is intended that all such changes be covered by the claims appended hereto.

What is claimed is:

1. A beverage dispenser for dispensing liquids, the dispenser comprising: a liquid mixing chamber; a nozzle for dispensing fluids from the mixing chamber; a first connector for connection to a source of a first liquid; a second connector for connection to a source of a second liquid; a first tube extending between the first connector and the mixing chamber and including a first valve therein to control the flow of the first liquid through the first tube; a second tube extending between the second connector and the mixing chamber and including a second valve therein to control the flow of the second liquid through the second tube; and an actuator including a plunger extending through the mixing chamber, the plunger being moveable between a first position preventing flow of any liquids, a second position causing the first valve to open to permit flow of the first liquid into the mixing chamber and a third position causing the first valve and the second valve to open to permit a flow of the first and the second fluids into the mixing chamber.

2. The beverage dispenser of claim 1 wherein the valves are ball valves biased to protrude into the mixing chamber such that they are borne upon by the plunger when it moves through the mixing chamber.

3. The beverage dispenser of claim 1 further comprising valves for controlling the flow of further liquids into the mixing chamber.

4. The beverage dispenser of claim 1 further comprising a third valve controlling the flow of a third liquid and the plunger being moveable into a fourth position in which the first valve and the third valve are opened to permit flow of the first and the third fluids into the mixing chamber.

5. The beverage dispenser of claim 1 herein the plunger is moved between the various positions by rotating it within the mixing chamber and moving it axially therethrough.

6. The beverage dispenser of claim 1 further comprising guides for guiding the plunger into the various positions.

7. The beverage dispenser of claim 1 further comprising a locking means and wherein the plunger is moveable into a locked position such that a specific unlocking procedure must be used in order to move the plunger into any of the various positions for dispensing fluids.

8. A beverage dispenser comprising: a liquid mixing chamber; a nozzle for dispensing fluids from the mixing chamber; a first tube for conveying a first liquid from a source of the first liquid through an opening into the mixing chamber; a second tube for conveying a second liquid from a source of the second liquid through an opening into the mixing chamber, a valve positioned in the opening, the valve being openable to permit a flow of the second liquid into the mixing chamber, the first tube emptying the first liquid into the mixing chamber above the opening of the second tube and the mixing chamber formed such that the first liquid from the first tube flows over the valve of the second tube on its way to the nozzle; and an actuator to control the flow of liquids into the mixing chamber, the actuator being selected to permit the flow of the first liquid into the mixing chamber a period of time prior to permitting flow through the second opening.

9. The beverage dispenser of claim 8 wherein the actuator is selected to maintain the flow of the first liquid into the mixing chamber for a period of time after the flow of the second liquid is stopped.

10. The beverage dispenser of claim 8 wherein the actuator includes a plunger formed to effect channeling of the first liquid over the valve of the second tube.

11. The beverage dispenser of claim 10 wherein the plunger includes ribs for funneling the first liquid over the valve of the second tube.

12. The beverage dispenser of claim 8 further comprising tubes for conveying further fluids into the mixing chamber and the openings for those tubes are positioned below the opening of the first tube such that the first liquid will flow past the openings of the further tubes on its way to the nozzle.

13. A beverage dispenser comprising: a liquid mixing chamber; a nozzle for dispensing fluids from the mixing chamber; a first tube for conveying a first liquid from a source of the first liquid through an opening into the mixing chamber; a second tube for conveying a second liquid from a source of the second liquid through an opening into the mixing chamber, a valve positioned in the opening, the valve being openable to permit a flow of the second liquid into the mixing chamber, the first tube emptying the first liquid into the mixing chamber above the opening of the second tube and the mixing chamber formed such that the first liquid from the first tube flows over the valve of the second tube on its way to the nozzle; and an actuator to control the flow of liquids into the mixing chamber, the actuator being selected to maintain the flow of the first liquid into the mixing chamber for a period of time after the flow of the second liquid is stopped.

14. The beverage dispenser of claim 13 wherein the actuator is selected to permit the flow of the first liquid into the mixing chamber a period of time prior to permitting flow through the second opening.

15. The beverage dispenser of claim 13 wherein the actuator includes a plunger formed to effect channeling of the first liquid over the valve of the second tube.

16. The beverage dispenser of claim 15 wherein the plunger includes ribs for funneling the first liquid over the valve of the second tube.

17. The beverage dispenser of claim 13 further comprising tubes for conveying further fluids into the mixing chamber and the openings for those tubes are positioned below the opening of the first tube such that the first liquid will flow past the openings of the further tubes on its way to the nozzle.

18. A beverage dispenser comprising: a liquid mixing chamber; a nozzle for dispensing fluids from the mixing chamber; a first tube for conveying a first liquid from a source of the first liquid through an opening into the mixing chamber; a second tube for conveying a second liquid from a source of the second liquid through an opening into the mixing chamber, the first tube emptying the first liquid into the mixing chamber above the opening of the second tube and the mixing chamber formed such that the first liquid from the first tube flows past the opening of the second tube on its way to the nozzle; and an actuator to control the flow of liquids into the mixing chamber, the actuator including a plunger having ribs for funneling the first liquid over the opening of the second tube.

19. The beverage dispenser of claim 18 wherein the actuator is selected to permit the flow of the first liquid into the mixing chamber a period of time prior to permitting flow through the second opening.

20. The beverage dispenser of claim 18 wherein the actuator is selected to maintain the flow of the first liquid into the mixing chamber for a period of time after the flow of the second liquid is stopped.

21. The beverage dispenser of claim 18 further comprising tubes for conveying further fluids into the mixing chamber and the openings for those tubes are positioned below the opening of the first tube such that the first liquid will flow past the openings of the further tubes on its way to the nozzle.

22. A beverage dispenser comprising: a liquid mixing chamber; a nozzle for dispensing fluids from the mixing chamber; a first tube for conveying a first liquid from a source of the first liquid through an opening into the mixing chamber; a second tube for conveying a second liquid from a source of the second liquid through an opening into the mixing a valve positioned in the opening, the valve being openable to permit a flow of the second liquid into the mixing chamber, the first tube emptying the first liquid into the mixing chamber above the opening of the second tube and the mixing chamber formed such that the first liquid from the first tube flows over the valve of the second tube on its way to the nozzle; and tubes for conveying further fluids into the mixing chamber and the openings for those tubes being positioned below the opening of the first tube such that the first liquid will flow past the openings of the further tubes on its way to the nozzle.

23. The beverage dispenser of claim 22 wherein the actuator is selected to permit the flow of the first liquid into the mixing chamber a period of time prior to permitting flow through the second opening.

24. The beverage dispenser of claim 22 wherein the actuator is selected to maintain the flow of the first liquid into the mixing chamber for a period of time after the flow of the second liquid is stopped.

25. The beverage dispenser of claim 22 wherein the actuator includes a plunger formed to effect channeling of the first liquid over the valve of the second tube.

26. The beverage dispenser of claim 25 wherein the plunger includes ribs for funneling the first liquid over the valve of the second tube.

* * * * *